US008744330B2

(12) United States Patent
Yoshinaga et al.

(10) Patent No.: US 8,744,330 B2
(45) Date of Patent: Jun. 3, 2014

(54) FIXING DEVICE HAVING A PLURALITY OF HEAT SOURCES AND A PLURALITY OF TEMPERATURE DETECTORS AND IMAGE FORMING APPARATUS INCLUDING SAME

(75) Inventors: Hiroshi Yoshinaga, Chiba (JP); Akira Shinshi, Tokyo (JP); Kenichi Hasegawa, Kanagawa (JP); Ryota Yamashina, Kanagawa (JP); Yasunori Ishigaya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 202 days.

(21) Appl. No.: 13/064,107

(22) Filed: Mar. 7, 2011

(65) Prior Publication Data

US 2011/0217057 A1 Sep. 8, 2011

(30) Foreign Application Priority Data

Mar. 8, 2010 (JP) ..... 2010-050501

(51) Int. Cl.
*G03G 15/20* (2006.01)

(52) U.S. Cl.
USPC ..... 399/329

(58) Field of Classification Search
USPC ..... 399/33, 69, 328, 329, 334; 219/216
See application file for complete search history.

(56) References Cited

U.S. PATENT DOCUMENTS

| | | | |
|---|---|---|---|
| 6,131,009 | A | 10/2000 | Hasegawa |
| 6,496,666 | B2 | 12/2002 | Hayashi et al. |
| 6,591,081 | B2 | 7/2003 | Hasegawa |
| 6,628,916 | B2 | 9/2003 | Yasui et al. |
| 6,636,709 | B2 | 10/2003 | Furukawa et al. |
| 6,778,790 | B2 | 8/2004 | Yoshinaga et al. |
| 6,778,804 | B2 | 8/2004 | Yoshinaga et al. |
| 6,785,505 | B2 | 8/2004 | Yasui et al. |
| 6,881,927 | B2 | 4/2005 | Yoshinaga et al. |
| 6,882,820 | B2 | 4/2005 | Shinshi et al. |
| 6,892,044 | B2 | 5/2005 | Yasui et al. |

(Continued)

FOREIGN PATENT DOCUMENTS

| | | |
|---|---|---|
| CN | 101017357 | 8/2007 |
| CN | 101038471 | 9/2007 |

(Continued)

OTHER PUBLICATIONS

JP H04-044075 (English Abstract).

(Continued)

*Primary Examiner* — Robert Beatty
(74) *Attorney, Agent, or Firm* — Harness, Dickey & Pierce, P.L.C.

(57) ABSTRACT

A fixing device includes a heat conductive member; a flexible fixing belt looped around the heat conductive member, an inner circumference of the flexible fixing belt slidably contacting a portion of an outer circumferential surface of the heat conductive member; a rotary pressing member disposed opposing the heat conductive member; heat sources disposed in a circumferential direction of the fixing belt at a predetermined interval to heat the heat conductive member; and temperature detectors provided to detect a surface temperature of the fixing belt at a detection position at which heating intensity of a corresponding one of the heat sources is not affected by any other one. In operation, the inner circumferential surface of the fixing belt contacts the heat conductive member at a position at which each temperature detector contacts the fixing belt as the detection position or a position proximal to the detection position of each temperature detector.

22 Claims, 11 Drawing Sheets

(56) References Cited

U.S. PATENT DOCUMENTS

| | | | | |
|---|---|---|---|---|
| 7,022,944 | B2 | 4/2006 | Yoshinaga et al. | |
| 7,070,182 | B2 | 7/2006 | Hasegawa | |
| 7,127,204 | B2 | 10/2006 | Satoh et al. | |
| 7,151,907 | B2 | 12/2006 | Yoshinaga | |
| 7,239,838 | B2 | 7/2007 | Sato et al. | |
| 7,242,896 | B2 * | 7/2007 | Haseba et al. | 399/329 |
| 7,242,897 | B2 | 7/2007 | Satoh et al. | |
| 7,313,353 | B2 | 12/2007 | Satoh et al. | |
| 7,330,682 | B2 | 2/2008 | Shinshi | |
| 7,361,863 | B2 * | 4/2008 | Tsunoda | 219/216 |
| 7,379,698 | B2 | 5/2008 | Yoshinaga | |
| 7,437,110 | B2 * | 10/2008 | Kondo et al. | 399/320 |
| 7,454,151 | B2 | 11/2008 | Satoh et al. | |
| 7,509,085 | B2 | 3/2009 | Yoshinaga et al. | |
| 7,515,850 | B2 | 4/2009 | Hasegawa | |
| 7,546,049 | B2 | 6/2009 | Ehara et al. | |
| 7,593,680 | B2 | 9/2009 | Shinshi | |
| 7,630,652 | B2 | 12/2009 | Hasegawa | |
| 7,742,714 | B2 | 6/2010 | Shinshi et al. | |
| 7,869,753 | B2 | 1/2011 | Shinshi | |
| 8,010,028 | B2 * | 8/2011 | Shinshi | 399/329 |
| 8,086,159 | B2 * | 12/2011 | Shinshi | 399/329 |
| 2002/0009306 | A1 | 1/2002 | Hayashi et al. | |
| 2002/0018663 | A1 | 2/2002 | Furukawa et al. | |
| 2002/0044805 | A1 | 4/2002 | Hasegawa | |
| 2002/0067936 | A1 | 6/2002 | Yasui et al. | |
| 2003/0000933 | A1 | 1/2003 | Yoshinaga et al. | |
| 2003/0007813 | A1 | 1/2003 | Yasui et al. | |
| 2003/0016963 | A1 | 1/2003 | Yoshinaga et al. | |
| 2003/0138263 | A1 | 7/2003 | Matsunaka et al. | |
| 2003/0206758 | A1 | 11/2003 | Yasui et al. | |
| 2003/0215271 | A1 | 11/2003 | Yoshinaga et al. | |
| 2004/0013453 | A1 | 1/2004 | Shinshi et al. | |
| 2004/0178573 | A1 | 9/2004 | Hasegawa | |
| 2005/0025539 | A1 | 2/2005 | Yoshinaga | |
| 2005/0095043 | A1 | 5/2005 | Yoshinaga et al. | |
| 2005/0163543 | A1 | 7/2005 | Satoh et al. | |
| 2006/0002737 | A1 | 1/2006 | Shinshi | |
| 2006/0029411 | A1 | 2/2006 | Ishii et al. | |
| 2006/0116230 | A1 | 6/2006 | Satoh et al. | |
| 2006/0165429 | A1 | 7/2006 | Satoh et al. | |
| 2006/0165443 | A1 | 7/2006 | Yoshinaga et al. | |
| 2006/0165448 | A1 | 7/2006 | Yoshinaga | |
| 2006/0257183 | A1 | 11/2006 | Ehara et al. | |
| 2007/0003334 | A1 | 1/2007 | Shinshi et al. | |
| 2007/0014600 | A1 | 1/2007 | Ishii et al. | |
| 2007/0014603 | A1 | 1/2007 | Satoh et al. | |
| 2007/0059003 | A1 | 3/2007 | Shinshi et al. | |
| 2007/0059071 | A1 | 3/2007 | Shinshi et al. | |
| 2007/0077104 | A1 | 4/2007 | Hasegawa | |
| 2007/0166085 | A1 | 7/2007 | Shinshi | |
| 2007/0183798 | A1 | 8/2007 | Moriguchi et al. | |
| 2007/0217837 | A1 | 9/2007 | Yamana et al. | |
| 2007/0292175 | A1 | 12/2007 | Shinshi | |
| 2008/0056330 | A1 | 3/2008 | Otsuka | |
| 2008/0063443 | A1 | 3/2008 | Yoshinaga et al. | |
| 2008/0112739 | A1 | 5/2008 | Shinshi | |
| 2008/0175633 | A1 | 7/2008 | Shinshi | |
| 2008/0219730 | A1 | 9/2008 | Shinshi | |
| 2008/0253788 | A1 | 10/2008 | Shinshi | |
| 2008/0253789 | A1 | 10/2008 | Yoshinaga et al. | |
| 2008/0298862 | A1 | 12/2008 | Shinshi | |
| 2008/0310862 | A1 | 12/2008 | Hasegawa | |
| 2008/0317532 | A1 | 12/2008 | Ehara et al. | |
| 2009/0067902 | A1 | 3/2009 | Yoshinaga et al. | |
| 2009/0123202 | A1 | 5/2009 | Yoshinaga et al. | |
| 2009/0148204 | A1 | 6/2009 | Yoshinaga et al. | |
| 2009/0169232 | A1 | 7/2009 | Kunii et al. | |
| 2009/0245865 | A1 | 10/2009 | Shinshi et al. | |
| 2009/0297199 | A1 | 12/2009 | Yamashina et al. | |
| 2009/0311016 | A1 | 12/2009 | Shinshi | |
| 2010/0061754 | A1 | 3/2010 | Ishigaya et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2011/0026897 | A1 | 2/2011 | Sobaje | |
| 2011/0026988 | A1 | 2/2011 | Yoshikawa et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0076071 | A1 | 3/2011 | Yamaguchi et al. | |
| 2011/0085832 | A1 | 4/2011 | Hasegawa et al. | |
| 2011/0091226 | A1 | 4/2011 | Ishigaya et al. | |
| 2011/0116848 | A1 | 5/2011 | Yamaguchi et al. | |
| 2011/0129268 | A1 | 6/2011 | Ishii et al. | |
| 2011/0188875 | A1 * | 8/2011 | Nakayama | 399/69 |

FOREIGN PATENT DOCUMENTS

| | | | | |
|---|---|---|---|---|
| CN | 101135590 | | | 3/2008 |
| CN | 101192040 | | | 6/2008 |
| JP | 08110732 | A | | 4/1996 |
| JP | 09325627 | A | * | 12/1997 |
| JP | 10213984 | A | | 8/1998 |
| JP | 10326054 | A | | 12/1998 |
| JP | 2884714 | A | | 4/1999 |
| JP | 2001-305906 | | | 11/2001 |
| JP | 2002-214952 | | | 7/2002 |
| JP | 3298354 | A | | 7/2002 |
| JP | 2003177627 | A | * | 6/2003 |
| JP | 2003271002 | A | | 9/2003 |
| JP | 2003297529 | A | * | 10/2003 |
| JP | 2004-020696 | A | | 1/2004 |
| JP | 3771486 | A | | 4/2006 |
| JP | 2006-259365 | | | 9/2006 |
| JP | 2007-212579 | | | 8/2007 |
| JP | 2007316463 | A | * | 12/2007 |
| JP | 2007334205 | A | | 12/2007 |
| JP | 2008-158482 | | | 7/2008 |

OTHER PUBLICATIONS

JP H08-262903 (English Abstract).

JP 2003-177627 (English Abstract).

Office Action for corresponding Chinese patent application No. 201110051023.1 dated Jul. 1, 2013.

Office Action for corresponding Japanese patent application No. 2010-050501 Oct. 29, 2013.

Office Action for corresponding Japanese patent application No. 2010-050501 dated Jan. 21, 2014.

Office Action for corresponding Chinese patent application No. 201110051023.1 dated Mar. 21, 2014.

* cited by examiner

FIXING DEVICE HAVING A PLURALITY OF HEAT SOURCES AND A PLURALITY OF TEMPERATURE DETECTORS AND IMAGE FORMING APPARATUS INCLUDING SAME

CROSS-REFERENCE TO RELATED APPLICATIONS

The present patent application claims priority pursuant to 35 U.S.C. §119 from Japanese Patent Application No. 2010-050501, filed on Mar. 8, 2010 in the Japan Patent Office, which is incorporated herein by reference in its entirety.

BACKGROUND

1. Field

Exemplary embodiments of the present disclosure relate to a fixing device and an image forming apparatus including the fixing device, and more specifically, a fixing device that fixes an image on a recording medium passing through a nip formed between a heat conductive member and a pressing member via an endless belt, and an image forming apparatus including the fixing device.

2. Description of the Background Art

Related-art image forming apparatuses, such as copiers, facsimile machines, printers, or multifunction apparatuses having at least one of copying, printing, scanning, and facsimile functions, typically form an image on a recording medium according to image data. In such an image forming apparatus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

For image forming apparatuses, different types of fixing devices are proposed. For example, a heat-roller type fixing device has a pressing roller and a fixing roller including a heat source. The pressing roller is pressed against the outer circumferential surface of the fixing roller to form a nip between them. In such a state, when a recording medium bearing an unfixed toner image passes through the nip, heat and pressure are applied to the recording medium at the nip to fix the toner image on the recording medium. In addition, a belt-type fixing roller is proposed to include an endless fixing belt extended between a heat roller and a fixing roller. From the outer surface of the fixing belt, the pressing roller is pressed against the fixing roller.

Furthermore, a fixing device is proposed to include a stationary member in sliding contact with the inner surface of a rotary member. For example, JP-H04-044075-A proposes a film-heating type fixing device, and JP-H10-213984-A proposes a pressing-belt type fixing device. However, a film-heating type fixing device like that described in JP-H04-044075-A has limitations in durability of a fixing belt and stability of the temperature of the fixing belt. For a pressing-belt type fixing device like that described in JP-H10-213984-A, a large heat capacity of fixing roller may increase the time required for raising the temperature of the fixing roller, thus increasing the warm-up time.

To deal with such a challenge, for example, JP-2007-334205-A proposes a fixing device including a fixing belt and a pipe-shaped heat conductive member. The heat conductive member is fixedly mounted within a loop formed by the fixing belt so as to be able to guide the circulation of the fixing belt. A heat source is disposed within the heat conductive member to heat the fixing belt via the heat conductive member.

Such a configuration can shorten the warm-up time of the fixing device. In addition, the pipe-shaped heat conductive member diffuses heat to uniformly heat the entire fixing belt, thus stabilizing the temperature of the entire fixing belt.

However, for the fixing device, since a plurality of halogen heaters is arranged side by side in contact with each other in the circumferential direction of the fixing belt, there is a dead angle at which a portion of radiation heat emitted from one halogen heater is blocked by the other halogen heater. In such a dead angle, a portion of the amount of heat from one halogen heater for heating the metal heat-conductive member is absorbed by the other halogen heater, thus preventing optimization of heating efficiency.

Further, detecting the temperature of the fixing belt in such a dead angle by a temperature detector (e.g., thermistor) is disadvantageous in terms of responsiveness and sensitivity. As a result, although the fixing device can shorten the warm-up time, the fixing belt might be overheated if, for example, continuous activation of the heater occurs due to a failure of the fixing device. In addition, for example, JP-2007-334205-A has no description of the relative positions of the temperature detector and a clearance between the fixing belt and the heat conductive member.

SUMMARY

In an aspect of this disclosure, there is provided an improved fixing device including a cylindrically heat conductive member, a flexible fixing belt, a rotary pressing member, a plurality of heat sources, and a plurality of temperature detectors. The flexible fixing belt is looped for rotation around the heat conductive member. An inner circumference of the flexible fixing belt slidably contacts a portion of an outer circumferential surface of the heat conductive member. The rotary pressing member is disposed opposing the heat conductive member with the flexible fixing belt interposed therebetween, forming a nip between the fixing belt and the rotary pressing member. The plurality of heat sources is disposed in a circumferential direction of the fixing belt at a predetermined interval to heat the heat conductive member. The plurality of temperature detectors is provided corresponding to the plurality of heat sources to detect a surface temperature of the fixing belt at a detection position at which heating intensity of a corresponding one of the plurality of heat sources is not affected by any other one of the plurality of heat sources. In operation, the inner circumferential surface of the fixing belt contacts the heat conductive member at a position at which each of the plurality of temperature detectors contacts the fixing belt as the detection position or a position proximal to the detection position of each of the plurality of temperature detectors.

In an aspect of this disclosure, there is provided an improved image forming apparatus including the fixing device described above.

In an aspect of this disclosure, there is provided an improved fixing device including a cylindrical heat conductive member, a flexible fixing belt, a rotary pressing member, a plurality of heat sources, and a plurality of overheat prevention units. The flexible fixing belt is looped for rotation around the heat conductive member. An inner circumference of the flexible fixing belt slidably contacts a portion of an outer circumferential surface of the heat conductive member. The rotary pressing member is disposed opposing the heat conductive member with the flexible fixing belt interposed therebetween, forming a nip between the fixing belt and the rotary pressing member. The plurality of heat sources is disposed in a circumferential direction of the fixing belt at a predetermined interval to heat the heat conductive member. The plurality of overheat prevention units is provided corresponding to the plurality of heat sources to detect a surface temperature of the fixing belt at a detection position at which heating intensity of a corresponding one of the plurality of heat sources is not affected by any other one of the plurality of heat sources.

In an aspect of this disclosure, there is provided an improved image forming apparatus including the fixing device described above.

BRIEF DESCRIPTION OF THE DRAWINGS

Additional aspects, features, and advantages of the present disclosure will be readily ascertained as the same becomes better understood by reference to the following detailed description when considered in connection with the accompanying drawings, wherein.

Figure 1:
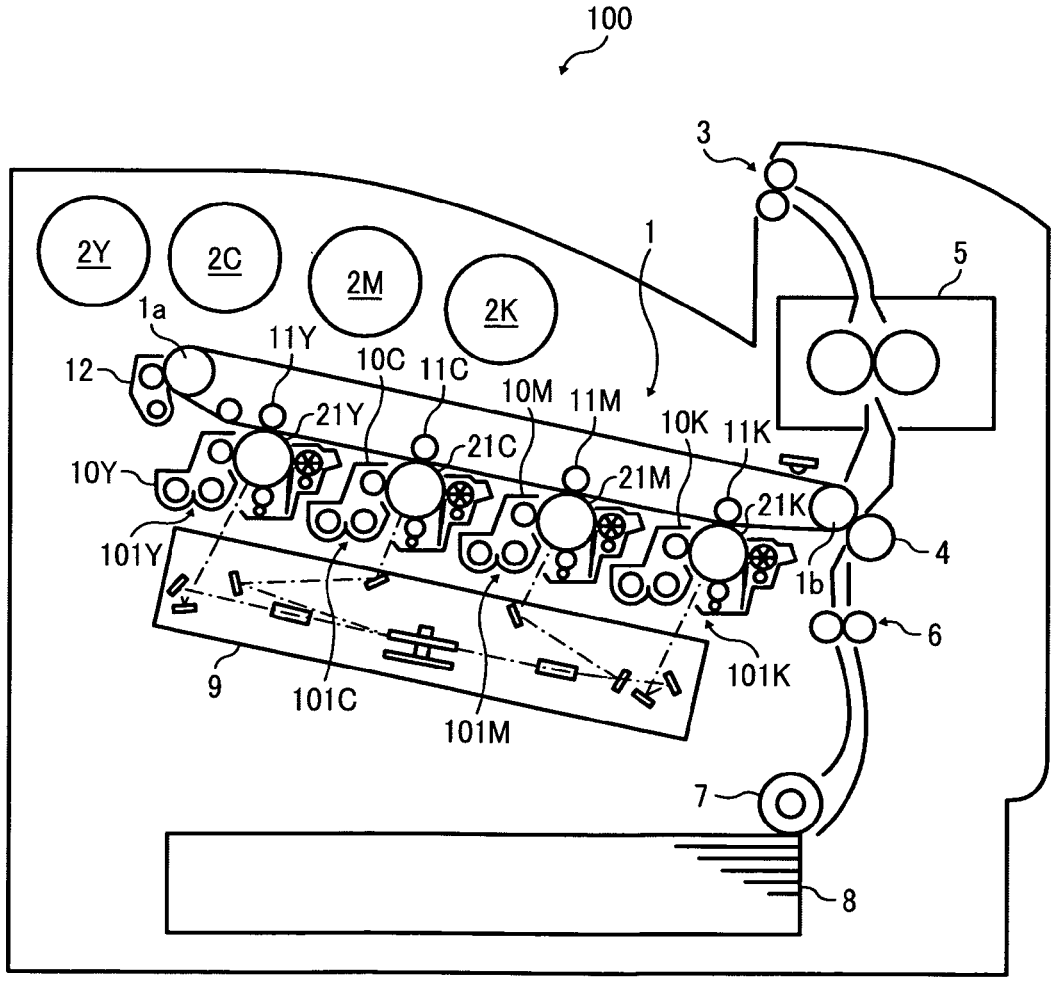
FIG. 1 is a schematic configuration view of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below with reference to FIGS. 1 to 13.

FIG. 1 is a schematic configuration view of an image forming apparatus 100 according to an exemplary embodiment of the present disclosure. In FIG. 1, the image forming apparatus 100 is a color laser printer. However, the image forming apparatus 100 is not limited to the color laser printer as illustrated in FIG. 1 and may be any other suitable type of image forming apparatus.

The image forming apparatus 100 includes an image forming section in which four image forming units are arranged side by side. Specifically, in the image forming section, four image forming units 101Y, 101C, 101M, and 101K that form toner images of yellow, cyan, magenta, and black, respectively, are arranged in this order from left to right in FIG. 1. The additional codes Y, C, M, and K used herein represent components for yellow, cyan, magenta, and black colors.

In the image forming section, the image forming units 101Y, 101C, 101M, and 101K include photoconductors 21Y, 21C, 21M, and 21K of, for example, drum shape serving as latent image bearing members. The photoconductors 21Y, 21C, 21M, and 21K are surrounded by chargers; development devices 10Y, 10C, 10M, and 10K, and photoconductor cleaners. At an upper portion of the image forming apparatus 100 are disposed toner bottles 2Y, 2C, 2M, and 2M containing yellow, cyan, magenta, and black toners. From the toner bottles 2Y, 2C, 2M, and 2M, desired amounts of color toners are supplied to the development devices 10Y, 10C, 10M, and 10K through conveyance paths.

Below the image forming section is disposed an optical writing unit 9 serving as a latent-image forming unit. The optical writing unit 9 includes light sources, a polygon mirror, a f-θ lens, and reflection mirrors, and scans surfaces of the photoconductors 21Y, 21C, 21M, and 21K while emitting laser beams in accordance with image data.

Above the image forming section is an intermediate transfer belt 1 of, e.g., an endless belt shape serving as an intermediate transfer member. The intermediate transfer belt 1 is looped around a driving roller 1*a* and a driven roller 1*b*, and a driving motor serving as a driving source is connected to a rotation shaft of the driving roller 1*a*. When the driving motor is driven, the intermediate transfer belt 1 is rotated counterclockwise in FIG. 1 and the driven roller 1*b* is also rotated. Within a loop formed by the intermediate transfer belt 1 are provided primary transfer devices 11Y, 11C, 11M, and 11K that transfer toner images from the photoconductors 21Y, 21C, 21M, and 21K onto the intermediate transfer belt 1.

Further, a secondary transfer roller 4 serving as a secondary transfer device is disposed downstream from the primary transfer devices 11Y, 11C, 11M, and 11K in the rotation direction of the intermediate transfer belt 1. The driven roller 1*b* serving as a pressing member is disposed opposite the secondary transfer roller 4 with the intermediate transfer belt 1 interposed therebetween. The image forming apparatus 100 further includes a sheet tray 8, a sheet feed roller 7, and a pair of registration rollers 6. Moreover, the image forming apparatus 100 includes a fixing device 5 to fix an image on a recording sheet S (e.g., a sheet of paper or a transfer material) and a pair of discharge rollers 3 to discharge the recording sheet S. The fixing device 5 and the pair of discharge rollers 3 are disposed downstream from the secondary transfer roller 4 in a transport direction of the recording sheet S.

Next, operation of the image forming apparatus 100 is described below. In the image forming units 101Y, 101C, 101M, and 101K, when the photoconductors 21Y, 21C, 21M, and 21K start to rotate, corresponding uniformly chargers charge the surfaces of the photoconductors 21Y, 21C, 21M, and 21K. The optical writing unit 9 emits laser beams onto the photoconductors 21Y, 21C, 21M, and 21K in accordance with image data to form electrostatic latent images on the photoconductors 21Y, 21C, 21M, and 21K. The development devices 10Y, 10C, 10M, and 10K supply toners to the photoconductors 21Y, 21C, 21M, and 21K to develop the latent images into visible toner images. Thus, single color images of yellow, cyan, magenta, and black are formed on the photoconductors 21Y, 21C, 21M, and 21K, respectively. When the driving roller 1*a* is rotated by the driving motor, the driven roller 1*b* and the secondary transfer roller 4 are rotated by the rotation of the driving roller 1*a*. As a result, the intermediate transfer belt 1 is rotated to transfer the respective visible toner images onto the intermediate transfer belt 1 at the primary transfer devices 11Y, 11C, 11M, and 11K. Thus, a composite color image is formed on the intermediate transfer belt 1. After the transfer process, the photoconductor cleaners remove residue toner particles remaining on the surfaces of the photoconductors 21Y, 21C, 21M, and 21K in preparation for the following image formation.

Meanwhile, the sheet feed roller 7 picks and feeds the recording sheet S from the sheet tray 8 to the pair of registration rollers 6. In synchronous with the above-described image formation, the pair of registration rollers 6 feeds the recording sheet S to a secondary transfer nip formed by the secondary transfer roller 4 and the intermediate transfer belt 1. The intermediate transfer belt 1 and the secondary transfer roller 4 sandwich the recording sheet S at the secondary transfer nip, and the composite toner image on the intermediate transfer belt 1 are transferred onto the recording sheet S by the secondary transfer roller 4.

After the secondary transfer process, the recording sheet S is transported to the fixing device 5 and sandwiched at a fixing nip formed by heating members (for example, a fixing belt 30 and a heat conductive member 31) and a rotary pressing member (pressing roller 40). At the fixing nip, heat and pressure are applied to the composite toner image on the recording sheet S. Thus, the toner image is fixed on the recording sheet S. The recording sheet S is discharged from the fixing nip and further from the pair of discharge rollers 3 to the exterior of the image forming apparatus 1. Meanwhile, after the secondary transfer process, an intermediate-transfer-member cleaner 12 removes residue toner particles remaining on the intermediate transfer belt 1 in preparation for the following image formation.

In this exemplary embodiment, the fixing device 5 includes an endless fixing belt (the fixing belt 30), a metal heat conductor (the heat conductive member 31) in sliding contact with a portion of an inner circumferential surface of the endless fixing belt, a heat source unit (a halogen heater unit 34) to heat the metal heat conductor, and a rotary pressing member (the pressing roller 40). The fixing device 5 also includes a plurality of heat sources (halogen heaters 34*a* and 34*b*) as the heat source unit and a plurality of temperature detectors (thermistors 35*a* and 35*b*) corresponding to the heat sources. The heat sources are arranged side by side in the circumferential direction of the fixing belt at a certain interval. Each of the temperature detectors is disposed at a position at which detection of the heating intensity of a corresponding one of the heat sources is not distorted by the other heat source. During rotation, the inner circumferential surface of the fixing belt contacts the metal heat conductor at a position at which each of the temperature detectors contacts the fixing belt or at a position of the fixing belt proximal to the detection position of each of the temperature detectors. The term "circumferential direction" used herein represents a rotation direction of the fixing belt or the pressing roller, and the term "axial direction" used herein represents a direction perpendicular to the rotation direction of the fixing belt or the pressing roller.

Next, a basic configuration of the fixing device 5 is described with reference to FIG. 2.

The fixing device 5 includes, as heating members, the fixing belt 30 and the heat conductive member 31 in proximity to the inner circumferential surface of the fixing belt 30. Within the heat conductive member 31 is disposed the halogen heater unit 34 serving as a heat source to heat the heat conductive member 31. The fixing device 5 further includes the pressing roller 40 serving as a rotary pressing member. It is to be noted that the heat source is not limited to a halogen heater and may be, for example, an infrared heater or a heat resistant member.

The fixing belt 30 is guided by the heat conductive member 31 over an area other than the fixing nip, and disposed so as to have a certain clearance of 1 mm or smaller between the heat conductive member 31 and it at a stationary state of the heat conductive member 31. Within the loop formed by the fixing belt 30, a nip formation member 32 is supported by the heat conductive member 31 so as to slide indirectly over the inner circumferential surface of the fixing belt 30 with a lubricant sheet 37 of, e.g., a mesh type interposed therebetween. Alternatively, the nip formation member 32 may directly contact the inner circumferential surface of the fixing belt 30. Further, as illustrated in FIG. 2, a heat insulator 36 may be provided between the nip formation member 32 and the heat conductive member 31.

Figure 2:
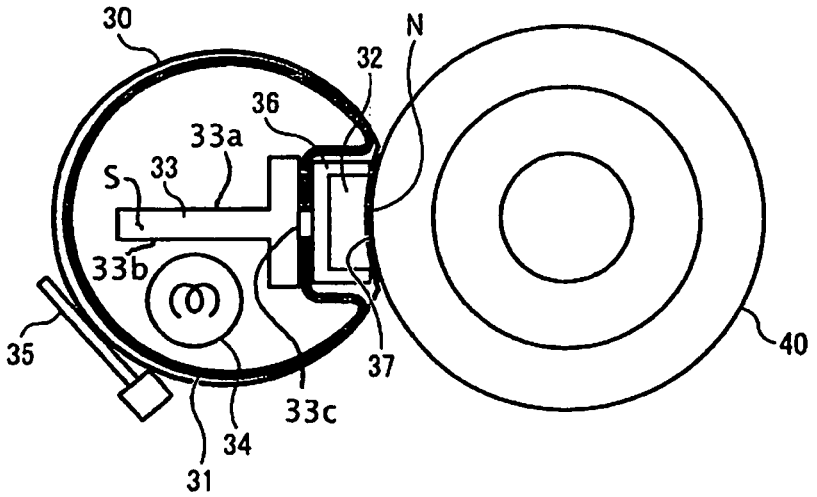
FIG. 2 is a schematic configuration view of a fixing device according to an exemplary embodiment of the present disclosure.

In FIG. 2, the fixing nip N is dented toward the heating-member side. Such a concave shape allows a recording sheet S to be discharged from the fixing nip N in a direction closer to the pressing roller 40 than the fixing belt 40, thus facilitating separation of the recording sheet S and preventing occurrence of paper jams. However, it is to be noted that the shape of the fixing nip N is not limited to such a concave shape and may be, e.g., a flat shape or any other suitable shape.

The pressing roller 40 includes a hollow metal roller having a silicon rubber layer and a surface releasing layer of tetrafluoroethylene-perfluoroalkylvinylether copolymer (PFA) or polytetrafluoroethylene (PTFE) to obtain a good releasing performance. The pressing roller 40 is rotated in a direction indicated by an arrow R in FIG. 2 by a driving force transmitted from a driving source, such as a motor, disposed in the image forming apparatus via gears.

Further, a spring or other urging member urges the pressing roller 40 toward the fixing belt 30. As a result, the silicon rubber layer of the pressing roller 40 is compressed and deformed to form a certain width of the fixing nip N. It is to be noted that the pressing roller 40 may be formed of a solid roller. However, a hollow roller is preferable in that the heat capacity is relatively small. The pressing roller 40 may include a heat source such as a halogen heater.

The silicone rubber layer of the pressing roller 40 may be solid rubber. Alternatively, if a heat source, such as a heater, is not provided in the pressing roller 40, the silicone rubber layer may be, e.g., sponge rubber. Sponge rubber is preferable in that the insulation performance is relatively high and thus less of the heat of the fixing belt 21 is absorbed by the pressing roller 40.

The fixing belt 30 is a metal belt including nickel, SUS (stainless steel), and/or other metal or a resin belt including polyimide and/or other resin. The fixing belt 30 has a surface releasing layer of, e.g., PFA or PTFE to prevent toner on the recording sheet S from adhering to the fixing belt 30. The fixing belt 30 may include an elastic layer of, e.g., silicone rubber between a base member and the surface releasing layer of, e.g., PFA or PTFE. If the fixing belt 30 does not include the elastic layer, the heat capacity of the fixing belt 30 is relatively small, thus enhancing the fixing performance. However, when an unfixed toner image is compressed by the surface of fixing belt 30, minute irregularity of the surface of the fixing belt 30 may be transferred on the toner image, causing minute irregularity (e.g., orange-peel-like asperity) on a solid portion of the toner image. To prevent such irregularity, it is preferable that the silicone rubber layer has a thickness of, e.g., 100 um or more. For such a configuration, deformation of the silicone rubber layer can absorb minute irregularity of the surface of the fixing belt 30, thus preventing the minute irregularity from being transferred onto the resultant toner image.

The heat conductive member 31 has a hollow pipe shape and includes aluminum, iron, stainless steel, and/or other metal. Unlike the pressing roller 40, the heat conductive member 31 is fixed so as not to rotate. In FIG. 2, the heat conductive member 31 has a substantially-circular cross section. However, it is to be noted that the cross section of the heat conductive member 31 illustrated in FIG. 2 is not limited to such a substantially circular shape and may be any other suitable shape. Further, the heat conductive member 31 is not limited to a pipe shape and may be any other shape capable of slidably supporting the fixing belt 30.

Moreover, within the heat conductive member 31 may be disposed a support member 33 to support the fixing nip N. For such a configuration, in a case in which the support member 33 is heated by, e.g., radiation heat of the halogen heater unit 34, the surface of the support member 33 may be thermally insulated or mirror-finished to block heat from the halogen heater unit 34, thus preventing wasteful heat energy consumption. In an example embodiment, the support member has a bottom face 33*c*, two side faces 33*b*, 33*a* and a space S between the two side faces, as shown for example in FIG. 2.

As a heat source for heating the heat conductive member 31, the fixing device 50 includes a plurality of halogen heaters in the halogen heater unit 34 and controls turning on-and-off of the halogen heaters independently of each other in accordance with the size of a recording sheet.

When the pressing roller 40 is rotated by the drive source, the drive force of the pressing roller 40 is transmitted to the fixing belt 30 at the fixing nip N to rotate the fixing belt 30. At the fixing nip N, the fixing belt 30 is sandwiched with the pressing roller 40 and the nip formation member 32 (via the lubricant sheet 37) to rotate. Meanwhile, over an area other than the fixing nip N, the fixing belt 30 is guided by the heat conductive member 31 so as not to move away from the heat conductive member 31 beyond a certain distance. In FIG. 2, lubricant (the lubricant sheet 37), such as silicone oil or fluorine grease, is applied to an interface between the fixing belt 30 and the heat conductive member 31.

The fixing device 50 also includes a controller to separately control the halogen heaters of the halogen heater unit 34 in accordance with detection results of the thermistors 35 serving as temperature detectors to control the surface temperature of the heat conductive member 31.

Such a configuration can shorten the warm-up time of the fixing device at a reduced cost and allows the heat conductive member 31 to e and transfer heat to the entire fixing belt 30 in a uniform manner. Thus, the fixing device 50 can stabilize the temperature of the entire fixing belt 30.

As described above, the fixing device 50 includes a plurality of halogen heaters serving as heat sources. In the following example, the fixing device 50 includes two halogen heaters 34*a* and 34*b*. However, it is to be noted that the number of halogen heaters in the fixing device 50 is not limited to two and may be any other suitable number.

For example, assuming that a single halogen heater is used to heat the fixing belt 30, when a recording sheet of a small width, such as a small-size sheet of paper, passes through the fixing nip N, heat of the fixing belt 30 is not absorbed by the recording sheet in an non-sheet-pass area thereof over which the recording sheet does not pass. Consequently, the surface temperature of the fixing belt 30 increases excessively. By contrast, for example, a first halogen heater having a light flux distribution toward an axial middle portion of the fixing belt 30 and a second halogen heater having a light flux distribution toward an axial end portion of the fixing belt 21 may be arranged side by side in a circumferential direction of the fixing belt 30. Controlling the halogen heaters thus arranged allows optimal temperature control in accordance with the width of a recording medium passing through the nip.

However, even in a case in the fixing device includes two halogen heaters, if the halogen heaters 34*a* and 34*b* are arranged in contact with each other in the circumferential direction, one of the heaters blocks radiation heat of the other an a greater angle, resulting in an increased dead angle.

Figure 3:
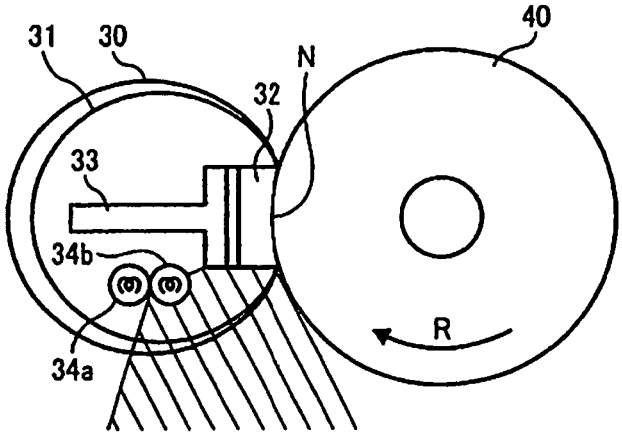
FIG. 3 is a schematic view showing a range of radiation heat from one of halogen heaters disposed in proximity to each other.

Specifically, as illustrated in FIG. 3, in a case in which the halogen heater 34*a* relatively upstream in the rotation direction of the fixing belt 30 is disposed in proximity to the halogen heater 34*b* relatively downstream in the rotation direction, radiation heat from the halogen heater 34*b* is blocked by the halogen heater 34*a* at a greater angle range. In such a case, the range of radiation heat from the halogen heater 34*b* to the heat conductive member 31 (indicated by a shaded area in FIG. 3) decreases, thus preventing the heat conductive member 31 from obtaining an optimal heating condition. Likewise, radiation heat from the halogen heater 34*a* is blocked by the halogen heater 34*b*. In this regard, FIGS. 3, 4A, 4B, and 4C show an irrotational (stopped) state of the fixing belt 30.

Figure 4A:
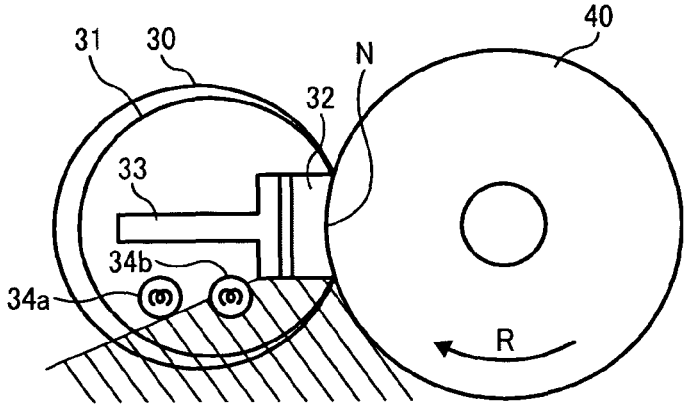
FIG. 4A is a schematic view showing a range of radiation heat from a downstream one of halogen heaters arranged in a certain interval.
Figure 4B:
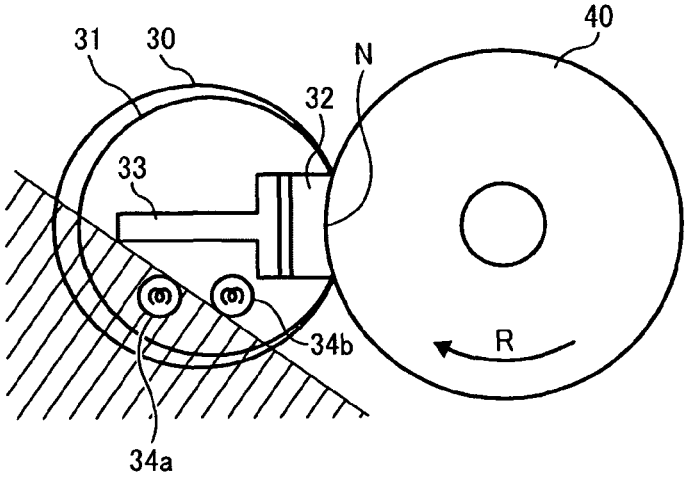
FIG. 4B is a schematic view showing a range of radiation heat from an upstream one of the halogen heaters.

Hence, as illustrated in FIG. 4A, the halogen heaters 34*a* and 34*b* are disposed at a certain distance from each other. Such a configuration eliminates (or reduces) the range in which radiation heat from one of the halogen heaters is blocked by the other, and thus extends the range of radiation heat emitted from the halogen heater 34*a* or 34*b* to the heat conductive member 31 (e.g., the range of radiation heat emitted from the halogen heater 34*b*, which is indicated by a shaded area in FIG. 4A). Accordingly, the heating efficiency of the heat conductive member 31 is enhanced. Likewise, the range of radiation heat emitted from the halogen heater 34*a* relatively upstream in the rotation direction of the fixing belt 30 is indicated by a shaded area in FIG. 4B.

Figure 4C:
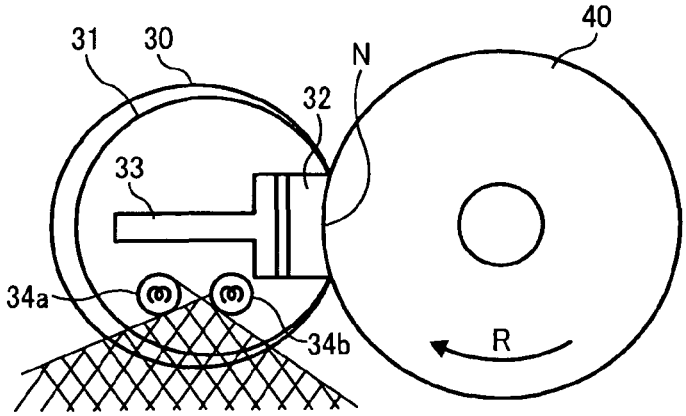
FIG. 4C is a schematic view showing a range of radiation heat from both of the halogen heaters.

Accordingly, the range in which the heat conductive member 31 receives radiation heat from the halogen heaters 34*a* and 34*b* is indicated by a shaded area in FIG. 4C.

In this configuration, if the thermistors 35 serving as temperature detectors corresponding to the halogen heaters 34*a* and 34*b* are disposed at the same position in the circumferential direction of the fixing belt 30, one of the halogen heaters 34*a* and 34*b* may prevent one of the thermistors 35 from obtaining a desired detection condition. That is, if one of the thermistors 35 is disposed within the range, as indicated by the shaded area in FIG. 4C, in which the heat conductive member 31 receives radiation heat from the halogen heaters 34*a* and 34*b*, controlling the turning on-and-off of one of the halogen heaters 34*a* and 34*b* by one of the thermistors 35 is affected by radiation heat from the other of the halogen heaters 34*a* and 34*b*. Consequently, accurate temperature detection may be prevented, thus making it difficult to achieve precise and stable temperature control.

Figure 5A:
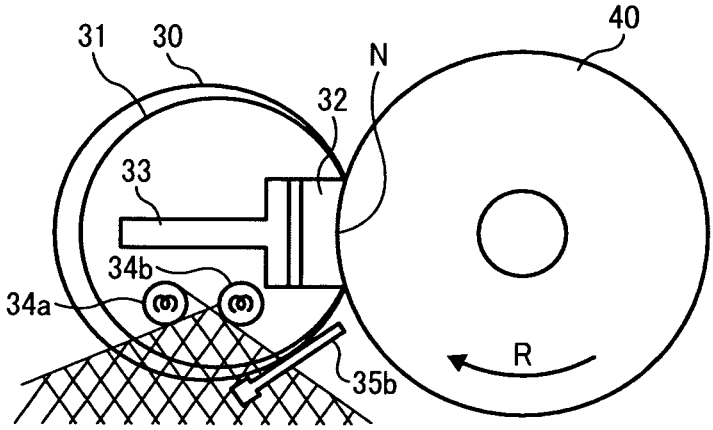
FIG. 5A is a schematic view showing a position of a temperature detector disposed corresponding to a downstream one of halogen heaters.
Figure 5B:
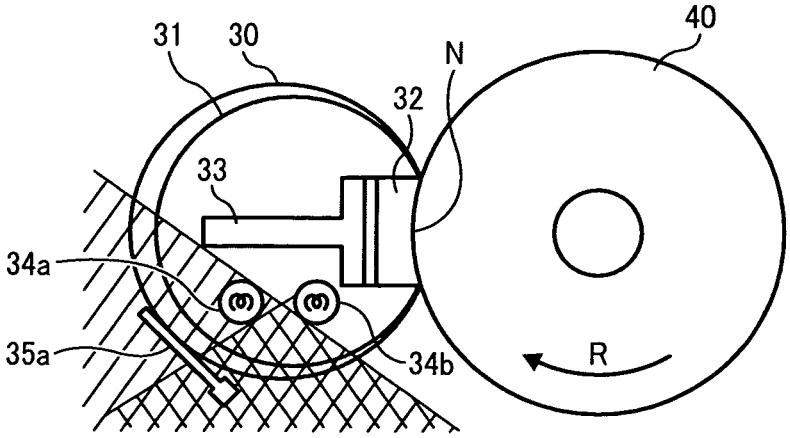
FIG. 5B is a schematic view showing a position of a temperature detector disposed corresponding to an upstream one of the halogen heaters.

Hence, as illustrated in FIGS. 5A and 5B, the thermistors 35*a* and 35*b* corresponding to the halogen heaters 34*a* and 34*b*, respectively, are disposed at such positions that radiation heat from one of the halogen heaters 34*a* and 34*b* is not blocked by the other. Such a configuration allows temperature detection at the most sensitive and heat-intensive position. Each of the thermistors 35*a* and 35*b* has a sensor at a band portion, and the sensor contacts the fixing belt 30 to detect a temperature of the fixing belt 30.

For this exemplary embodiment, the interval between the halogen heaters 34*a* and 34*b* (i.e., the distance between the axial centers of the halogen heaters 34*a* and 34*b*) is, for example, 10 mm. The interval between the plurality of heat sources and the positions of the temperature detectors corresponding to the heat sources are optimally determined in accordance with, e.g., the shapes, sizes, and materials of the fixing belt 30 and the heat conductive member 31 and the amount of heat of the heat sources.

In FIGS. 5A and 5B, the contact-type thermistors 35*a* and 35*b* detects the temperature of the fixing belt 30. Alternatively, non-contact-type thermistors or thermopiles may be used as temperature detectors. In such a case, as with the contact-type thermistors, the non-contact-type thermistors (or thermopiles) are disposed at such positions that radiation heat from one of the non-contact-type thermistors (or thermopiles) is not blocked by the other. Such a configuration can produce effects equivalent to those of the above-described configuration.

Next, the clearance between the fixing belt 30 and the heat conductive member 31 is described. As described above, the fixing belt 30 is guided by the heat conductive member 31 over an area other than the fixing nip N. The fixing belt 30 and the heat conductive member 31 have a certain clearance therebetween of, for example, 1 mm or smaller. Since the fixing belt 30 is not taut, the track of the fixing belt 30 is different between the rotational state and the stopped state.

Figure 6A:
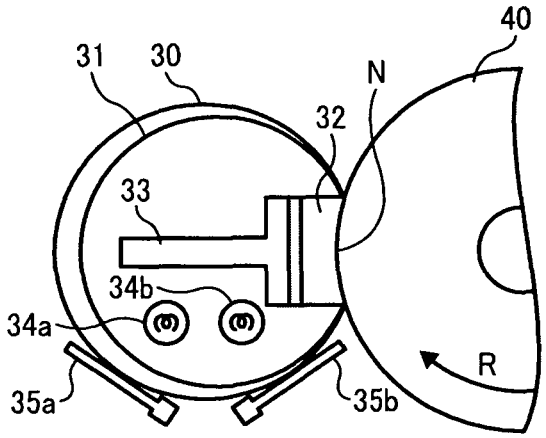
FIG. 6A is a schematic view showing an example of a track of a fixing belt at a stopped state.
Figure 6B:
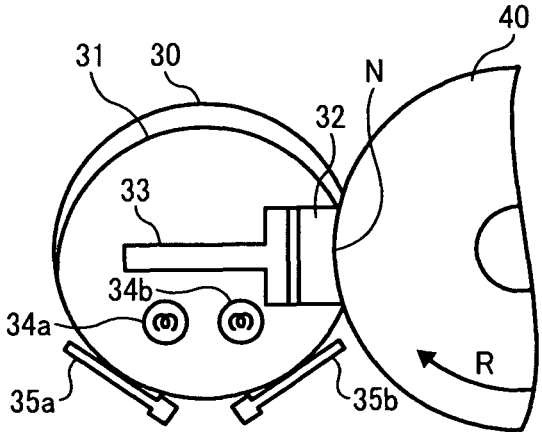
FIG. 6B is a schematic view showing an example of a track of the fixing belt at a rotational state.

As illustrated in FIG. 6A, at stationary state, a drive force (tension) is not applied to the fixing belt 30. That is, the fixing belt 30 is not taut on the entry side upstream of the fixing nip N, and thus the curvature of the fixing belt 30 on the entry side of the fixing nip N is symmetrical with the exit side downstream from the fixing nip N thereof. By contrast, as illustrated in FIG. 6B, during rotation, a drive force (tension) is applied to the fixing belt 30 in a direction from the entry side to the exit side of the fixing nip N. As a result, the inner circumferential surface of the fixing belt 30 comes into contact with the heat conductive member 31 at the entry side of the fixing nip N and moves away from the heat conductive member 31 at the exit side of the fixing nip N while keeping the above-described clearance of, e.g., 1 mm or smaller.

Figure 7:
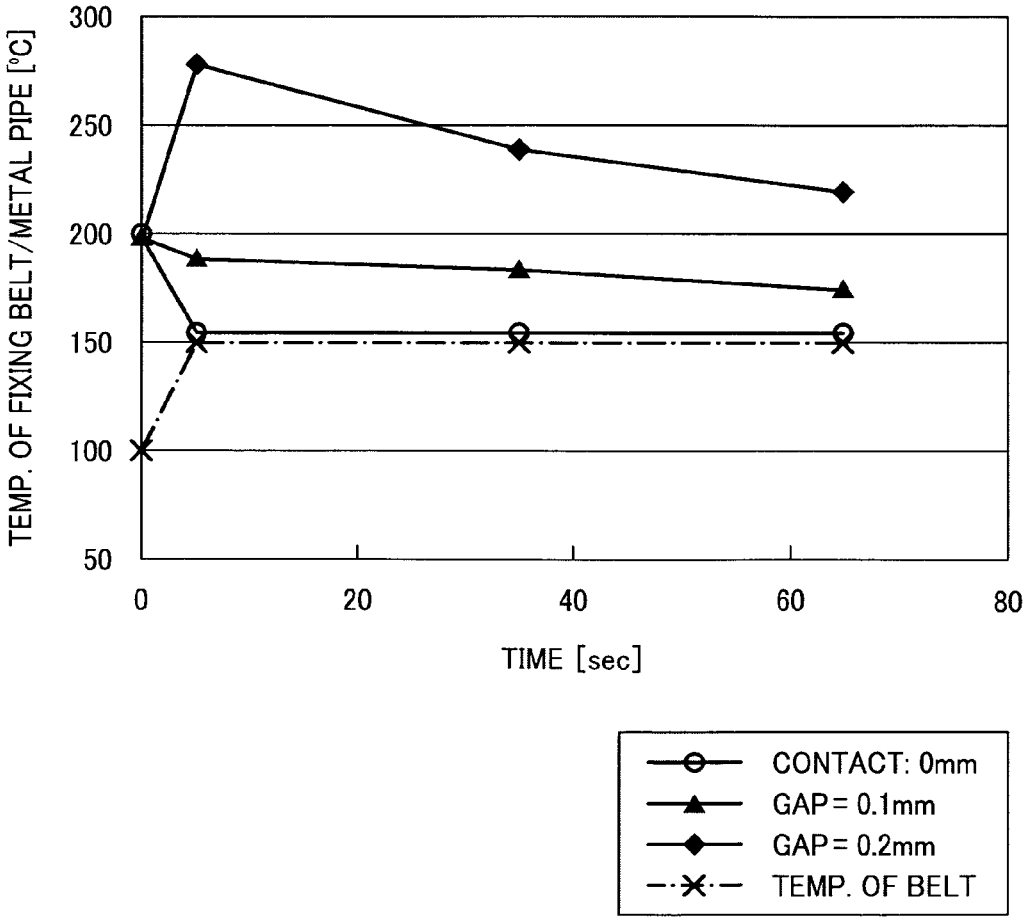
FIG. 7 is a graph showing the effect of a clearance between a fixing belt and a heat conductive member to temperatures of the fixing belt and the heat conductive member.

FIG. 7 is a graph showing the effect of the clearance between the fixing belt 30 and the heat conductive member 31 on the temperature of the fixing belt 30, and specifically, the temperature of the outer circumference surface of the heat conductive member required for maintaining the surface temperature of the fixing belt at a controlled fixing temperature, e.g., 150° C. for plain sheets. Specifically, in a stopped state, the surface of the fixing belt 21 is maintained at 100° C., and the surface of the heat conductive member 31 is maintained at 200° C. The clearance between the fixing belt 21 and the heat conductive member 31 is approximately 0.1 mm. From the stopped state, the fixing belt 21 starts to rotate and continues to rotate with the clearance between the fixing belt and the heat conductive member 31 being 0 mm (no clearance, i.e., contact state), 0.1 mm (constant clearance), and 0.2 mm (increased clearance), respectively. In such states, when the fixing belt 21 continues to rotate at a linear velocity of 120 mm/sec, temperatures of the outer circumferential surface of the heat conductive member 31 as illustrated in FIG. 7 are obtained.

As illustrated in FIG. 7, in the case of no clearance (contact state), at 5 seconds after the start of rotation, the surface temperature of the fixing belt 21 is 150° C. and the surface temperature of the heat conductive member 31 is 155° C. The difference between the surface temperatures of the fixing belt 21 and the heat conductive member 31 is 5° C. Thereafter, the graph shows substantially the same temperatures and the same temperature difference. By contrast, in the case in which the clearance is maintained at 0.1 mm, the surface temperature of the heat conductive member 31 gradually decreases from 200° C. over time. Further, in the case in which the clearance is increased from 0.1 mm to 0.2 mm, the surface temperature of the heat conductive member 31 rises to 280° C.

As described above, a clearance between the fixing belt 30 and the heat conductive member 31 creates a difference between the surface temperature of the fixing belt 30 detected by the thermistor unit 35 and the surface temperature of the heat conductive member 31. In particular, if the thermistor unit 35 is disposed at a position at which the clearance between the fixing belt 30 and the heat conductive member 31 appears during rotation of the fixing belt 30 in, e.g., image formation, the above-described temperature difference prevents accurate detection of the temperature of the fixing belt 30. Consequently, electric power may be wasted, or the heat conductive member 31 might become overheated. If the thermistor unit 35 is disposed at a position at which contact and separation of the fixing belt 30 with and from the heat conductive member 31 are repeated, unexpected overheating of the fixing belt 30 might occur. In particular, such overheating might occur in the fixing device capable of rapidly raising the temperature.

Hence, ordinarily it is necessary that the thermistor unit 35 is disposed at a position at which, during rotation, the fixing belt 30 comes into contact with the heat conductive member 31. It is also preferable that the thermistor unit 35 be disposed at a position at which, when the fixing belt 30 is stopped, the fixing belt 30 contacts the heat conductive member 31. However, when stopped, the fixing belt 30 is stationary and the clearance between the fixing belt 30 and the heat conductive member 31 is maintained constant. Further, by observing the stationary state, the clearance and temperature difference between the fixing belt and the heat conductive member 31 can be determined and defined in advance. The rapid temperature-rising capability of the fixing device allows the setting temperature in the rotation period of the fixing belt to be set to a relatively low temperature or the heater turned off. Accordingly, the thermistor unit 35 need not necessarily be disposed at the position at which the fixing belt 30 contacts the heat conductive member 31 when the fixing belt 30 is stopped.

Figure 8:
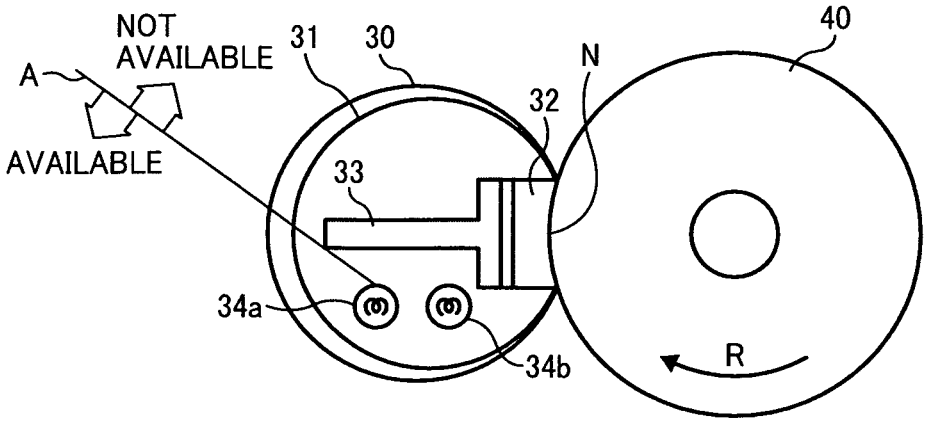
FIG. 8 is a schematic view showing relative positions of a support member and a temperature detector.

It is preferable that a support member 33 is provided within the heat conductive member 31 to support the fixing nip N. Such a configuration can enhance the accuracy with which the nip formation member 32 is positioned. As illustrated in FIG. 8, in a case in which the support member 33 is provided within the heat conductive member 31, the temperature detectors 35 are disposed where radiated heat of one of the halogen heaters of the halogen heater unit 34 is not blocked by either the other halogen heater or the support member 33. Such a configuration allows the temperature detectors to be disposed at the most sensitive and heat-intensive positions. In FIG. 8, if the thermistor 35*a* corresponding to the halogen heater 34*a* is disposed in an area extending in a direction indicated by an arrow "NOT AVAILABLE" from a border line A, radiated heat of the halogen heater 34*a* is blocked by the support member 33. Hence, the thermistor 35*a* is disposed in an area extending in a direction indicated by an arrow "AVAILABLE" from the border line A.

In a case in which the support member 33 is heated by radiation heat of the halogen heater unit 34, In such a case, the surface of the support member 33 may be insulated or mirror-finished to prevent heat absorption by the support member 33. Such a configuration can prevent wasteful heat energy consumption. Further, in addition to an appropriate surface treatment, the shape of the support member 33 may be modified as well.

Figure 9:
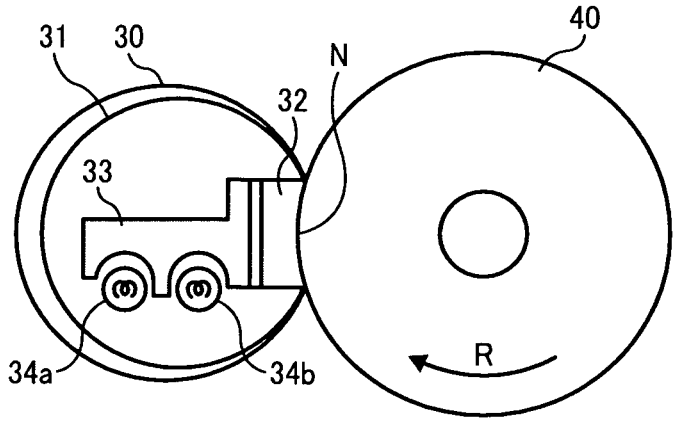
FIG. 9 is a schematic view showing a fixing device including a modified shape of support member.
Figure 10A:
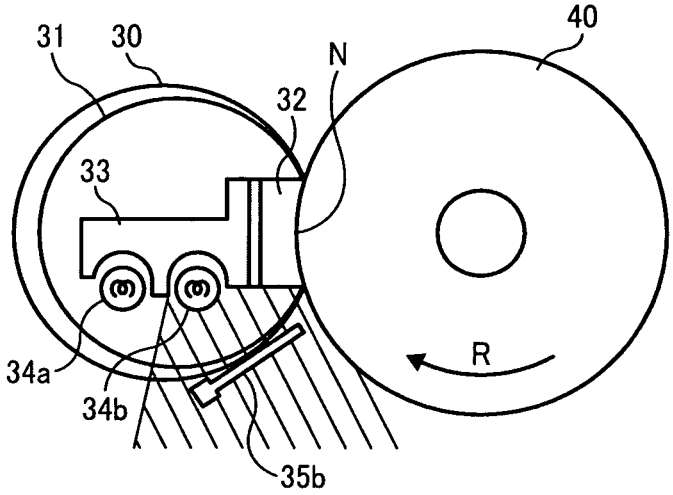
FIG. 10A is a schematic view showing a position of a temperature detector disposed corresponding to a downstream one of halogen heaters in the fixing device illustrated in FIG. 9.
Figure 10B:
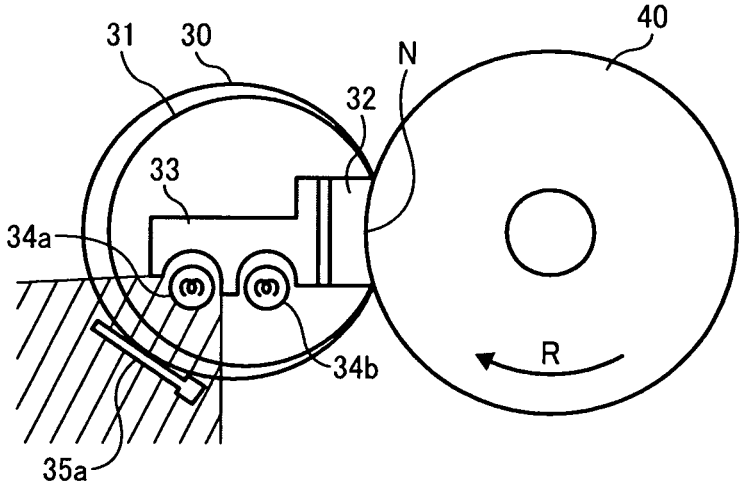
FIG. 10B a schematic view showing a position of another temperature detector disposed corresponding to an upstream one of the halogen heaters in the fixing device illustrated in FIG. 9.

For example, in accordance with the position and shape of the halogen heater unit 34, the shape of the support member 33 having such a mirror-finished surface may be modified as illustrated in FIG. 9. Such a configuration can prevent wasteful energy consumption. That is, as illustrated in FIGS. 10A and 10B, each of the thermistors 35*a* and 35*b* is disposed in an area in which radiation heat from each of the halogen heaters 34*a* and 34*b* converge. Thus, the thermistor unit 35 can be disposed at the most sensitive and heat-intensive area, allowing the heat from the halogen heater unit to be effectively used for heating of the fixing process. Such a configuration can detect a change in the temperature of the heating member immediately and precisely and control the temperature of the fixing nip N accurately and stably.

Figure 11A:
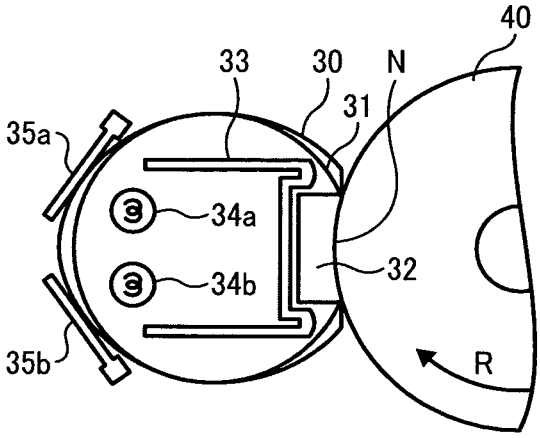
FIG. 11A is a schematic view showing another example of a track of a fixing belt at a stopped state.
Figure 11B:
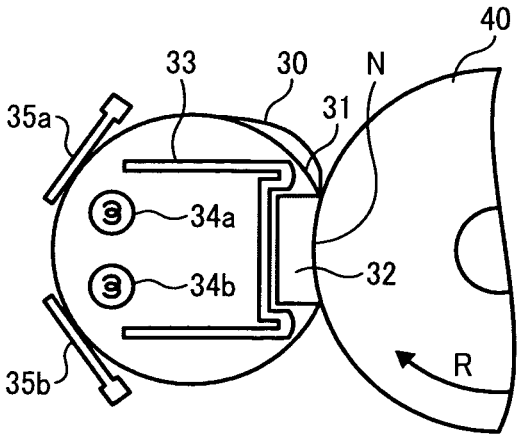
FIG. 11B is a schematic view showing another example of a track of the fixing belt at a rotational state.
Figure 12A:
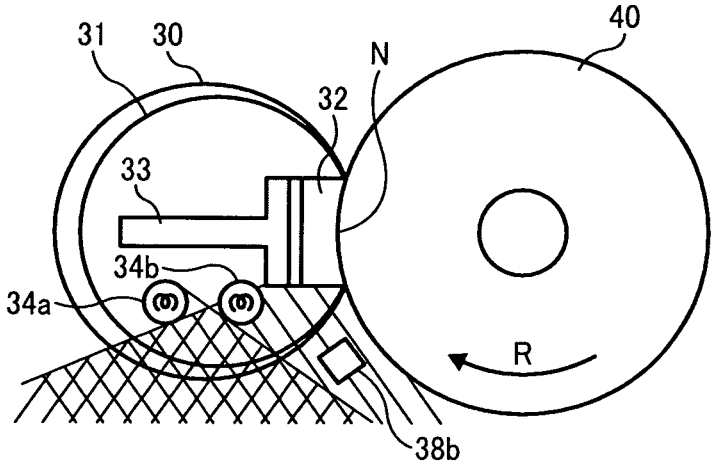
FIG. 12A is a schematic view showing a position of an overheat prevention unit disposed corresponding to a downstream one of halogen heaters.
Figure 12B:
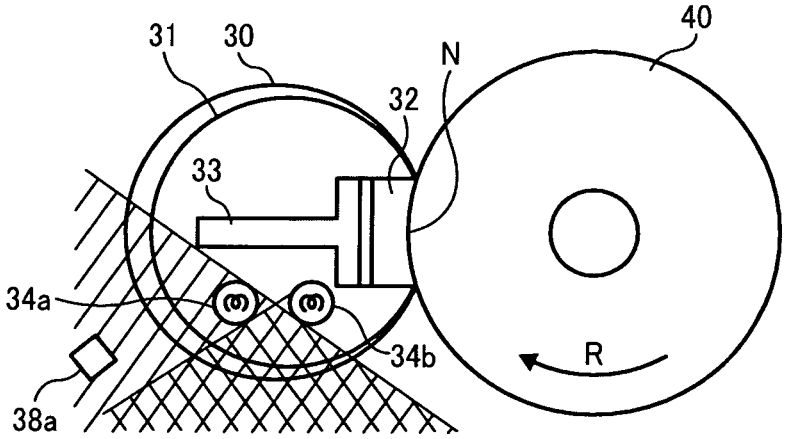
FIG. 12B is a schematic view showing a position of another overheat prevention unit disposed corresponding to an upstream one of the halogen heaters.

FIGS. 11A and 11B are a cross sectional view of a fixing device according to an exemplary embodiment. The shape of the support member 33 and the positions of the halogen heaters 34*a* and 34*b* differ from those of the fixing device illustrated in FIGS. 6A and 6B.

Forming the support member 33 in the shape illustrated in FIGS. 11A and 11B can enhance the pressing force of the nip formation member 32. Further, in the stopped state illustrated in FIG. 11A, as the pressing force at the fixing nip N increases, the fixing belt 30 is further away from the heat conductive member 31 at both the entry and exit sides of the fixing nip N. Likewise, at the opposite side of the fixing nip N (i.e., a position at which the fixing belt 30 arrives by rotating 180° C. from the fixing nip N), the fixing belt 30 is further separated away from the heat conductive member 31 by the stiffness of the fixing belt 30.

In addition, in the case in which the support member 33 has the shape illustrated in FIGS. 11A and 11B, the halogen heaters 34*a* and 34*b* are positioned upstream from the nip. In such a case in which the positions of the halogen heaters 34*a* and 34*b* are modified, the interval between the halogen heaters 34*a* and 34*b* and the interval between the heat conductive member 31 and each of the halogen heaters 34*a* and 34*b* are optimally positioned. The thermistors 35*a* and 35*b* corresponding to the halogen heaters 34*a* and 34*b*, respectively, are disposed at positions so that radiation heat from one of the halogen heaters 34*a* and 34*b* is blocked by the other. Such a configuration allows temperature detection at highly sensitive and heat-intensive positions.

In the configuration illustrated in FIGS. 11A and 11B, as with the above-described configuration, while the fixing belt 30 rotates, a drive force (tension) is applied in a direction from the entry side of the fixing nip N to the exit side of the fixing nip N. As a result, as illustrated in FIG. 11B, the fixing belt 30 during rotation follows a track differing from the track of the fixing belt at the stationary state.

In FIGS. 11A and 11B, the positions of the thermistors 35*a* and 35*b* can be maintained so that, during rotation, the inner circumferential surface of the fixing belt 30 contacts the heat conductive member 31, and in a stopped state, the inner circumferential surface of the fixing belt 30 is separated away from the heat conductive member 31 at a small clearance. As described above, even if the configuration of components, such as the shape of the support member 33, is different, the fixing device illustrated in FIGS. 11A and 11B can obtain effects equivalent to those of the fixing device illustrated in FIGS. 6A and 6B.

As described above, for the fixing device according to this exemplary embodiment, one of the plurality of halogen heaters serving as heat sources is disposed at a position so as not to block heat from the other. Such a configuration can shorten the warm-up time and effectively diffuse heat from the heat conductive member 31 to uniformly heat the entire fixing belt. Accordingly, the fixing device can stabilize the temperature of the entire fixing belt with a simple configuration, thus resulting in cost reduction.

In the fixing device, the temperature detectors are disposed at positions suitable in response and/or sensitivity so that the temperature detectors are most sensitive and heat-intensive for the corresponding halogen heaters, and the temperature detection of the temperature detectors is not affected by the clearance between the fixing belt and the heat conductive member. Such a configuration can promptly and accurately detect a change in the temperature of the heating member caused by, for example, sheet passing through the nip, and accurately and stably control the temperature of the fixing nip N.

Alternatively, instead of or in addition to the temperature detectors, the fixing device may include overheat prevention units 38, such as thermostats.

In the fixing device, the overheat prevention units 38 may be disposed at the same positions as those of the above-described temperature detectors. For example, the thermostats 38*a* and 38*b* corresponding to the halogen heaters 34*a* and 34*b*, respectively, may be disposed at positions illustrated in FIGS. 12A and 12B. In a case in which there is no space to arrange both the overheat prevention units (e.g., the thermostats) 38 and the temperature detectors (e.g., the thermistors) 35 in the circumferential direction of the fixing belt, one set of the overheat prevention units 38 and the temperature detectors 35 may be shifted in the axial direction of the fixing belt.

Since the fixing device is energy-saving and warms up quickly, the fixing belt need not be heated during standby time. Accordingly, normally, in non-sheet passing period (the stopped state of the fixing belt), the temperature detectors and the halogen heaters may be turned off. By contrast, the overheat prevention units needs to monitor the fixing belt irrespective of rotational or stopped states because, even in the stopped state, the fixing belt may run out of control due to, e.g., a short circuit in electric circuits.

It is preferable that the overheat prevention units 38*a* and 38*b* are disposed at positions so that the fixing belt 30 contacts with the heat conductive member 31 in a stopped state as well as during rotation. However, in a stopped state, the fixing belt 30 is stationary and the clearance between the fixing belt 30 and the heat conductive member 31 is maintained substantially constant. Further, if the clearance is small enough for the fixing device to be able to control it, it does not matter that the fixing device has the clearance between the fixing belt 30 and the heat conductive member 31 in a stopped state.

Figure 13:
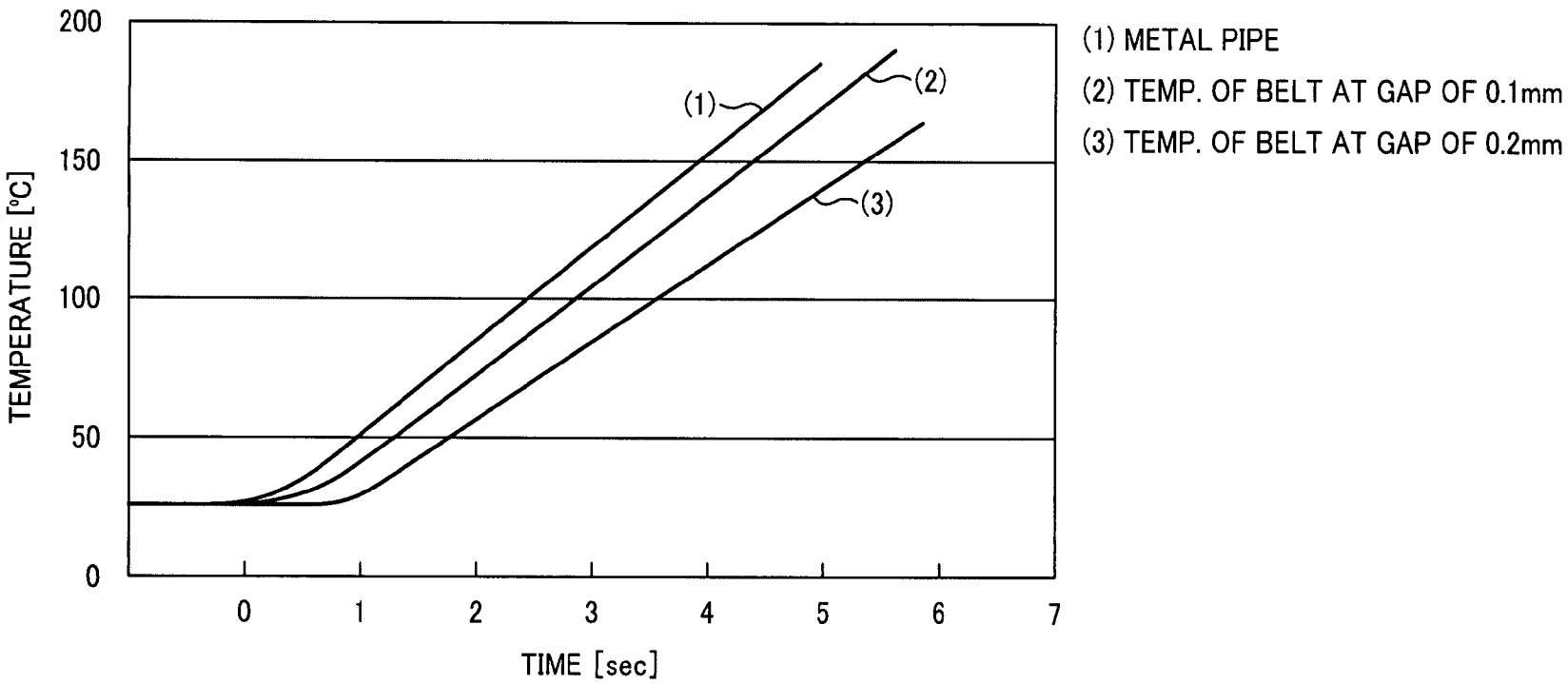
FIG. 13 is a graph showing characteristics in temperature rising of the surface of the heat conductive member and the surface of the fixing belt maintained at a clearance from the heat conductive member when the fixing belt is stopped.

FIG. 13 is a graph showing characteristics in temperature rising of the surface of the heat conductive member 31 and the surface of the fixing belt maintained at a clearance from the heat conductive member 31 when the fixing belt is stopped. Rising curve 1 represents the surface of the heat conductive member 31. Rising curve 2 represents the surface of the fixing belt maintained at a clearance of 0.1 mm. Rising curve 3 represents the surface of the fixing belt maintained at a clearance of 0.2 mm.

In FIG. 13, even with the clearance of 0.1 mm, the surface temperature of the fixing belt 30 follows the surface temperature of the heat conductive member 31 within the difference of 20° C. or less, thus preventing overheating of the fixing belt. For the clearance of 0.2 mm, the temperature difference between the surface of the fixing belt 30 and the surface of the heat conductive member 31 might increase to approximately 50° C. Therefore, the clearance of 0.2 mm is not appropriate for the prevention of overheating of the fixing belt.

It is to be noted that the values shown in FIG. 13 are inherent to the respective configurations of the fixing device and determined in accordance with conditions, such as layer structure, of the fixing belt. Accordingly, if the fixing device or the image forming apparatus can be formed so as to satisfy the conditions for preventing overheating when the fixing belt is stopped, the clearance need not necessarily be limited to 0.1 mm or less. As described above, it is not necessarily required that, in a stopped state, the fixing belt 30 contacts the heat conductive member 31. However, in a stopped state, an appropriate clearance need be maintained between the fixing belt 30 and the heat conductive member 31.

Since the fixing device according to this exemplary embodiment can raise the temperature quickly, it is preferable that the thermostats can accurately response at high speed. The above-described configuration can provide such overheat prevention units capable of controlling at high speed and accuracy.

By using the fixing device 5 having the above-described configuration in the image forming apparatus 100, the image forming apparatus 100 can function as described above.

Numerous additional modifications and variations are possible in light of the above teachings. It is therefore to be understood that within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing device comprising:

a non-rotatable heat conductive member;

a flexible fixing belt looped for rotation around the heat conductive member, an inner circumference of the flexible fixing belt slidably contacting a portion of an outer circumferential surface of the heat conductive member;

a rotary pressing member disposed opposing the heat conductive member with the flexible fixing belt interposed therebetween, forming a nip between the fixing belt and the rotary pressing member;

a plurality of heat sources disposed in a circumferential direction of the fixing belt at a predetermined interval to heat the heat conductive member; and a plurality of temperature detectors provided corresponding to the plurality of heat sources to detect a surface temperature of the fixing belt at a detection position at which heating intensity of a corresponding one of the plurality of heat sources is not affected by any other one of the plurality of heat sources, and in operation, the inner circumferential surface of the fixing belt contacts the heat conductive member at a position at which each of the plurality of temperature detectors contacts the fixing belt as the detection position or a position proximal to the detection position of each of the plurality of temperature detectors.

2. The fixing device according to claim 1, wherein, the predetermined interval is an interval at which the corresponding one of the plurality of heat sources does not block heat radiated from any other one of the plurality of heat sources from being received by at least one of the plurality of temperature detectors.

3. The fixing device according to claim 1, wherein the detection position of each of the plurality of temperature detectors is a position at which the corresponding one of the plurality of heat sources radiates heat at maximum intensity.

4. The fixing device according to claim 1, further comprising:

a nip formation member held by the heat conductive member; and a support member to support the nip formation member, wherein, at the detection position of each of the plurality of temperature detectors, the heating intensity of the corresponding one of the plurality of heat sources is not affected by the support member.

5. The fixing device according to claim 4, wherein a surface of the support member is thermally insulated.

6. The fixing device according to claim 5, wherein the surface of the support member has a mirror finish reflecting radiated heat from the plurality of heat sources.

7. An image forming apparatus comprising a fixing device according to claim 1.

8. A fixing device comprising:

a non-rotatable heat conductive member;

a flexible fixing belt looped for rotation around the heat conductive member, an inner circumference of the flexible fixing belt slidably contacting a portion of an outer circumferential surface of the heat conductive member;

a rotary pressing member disposed opposing the heat conductive member with the flexible fixing belt interposed therebetween, forming a nip between the fixing belt and the rotary pressing member;

a plurality of heat sources disposed in a circumferential direction of the fixing belt at a predetermined interval to heat the heat conductive member; and a plurality of overheat prevention units provided corresponding to the plurality of heat sources to detect a surface temperature of the fixing belt at a detection position at which heating intensity of a corresponding one of the plurality of heat sources is not affected by any other one of the plurality of heat sources.

9. The fixing device according to claim 8, wherein the predetermined interval is an interval at which the corresponding one of the plurality of heat sources does not block heat radiated from any other one of the plurality of heat sources from being received by at least one of the plurality of temperature detectors.

10. The fixing device according to claim 8, wherein the detection position of each of the plurality of temperature detectors is a position at which the corresponding one of the plurality of heat sources radiates heat at maximum intensity.

11. The fixing device according to claim 8, further comprising:

a nip formation member held by the heat conductive member; and a support member to support the nip formation member, wherein, at the detection position of each of the plurality of temperature detectors, the heating intensity of the corresponding one of the plurality of heat sources is not affected by the support member.

12. The fixing device according to claim 11, wherein a surface of the support member is thermally insulated.

13. The fixing device according to claim 12, wherein the surface of the support member has a mirror finish reflecting radiated heat from the plurality of heat sources.

14. An image forming apparatus comprising a fixing device according to claim 8.

15. A fixing device comprising:

a flexible fixing belt looped for rotation;

a rotary pressing member disposed opposing the flexible fixing belt interposed therebetween, forming a nip between the fixing belt and the rotary pressing member;

a plurality of heat sources disposed in the fixing belt; and a plurality of temperature detectors provided corresponding to the plurality of heat sources to detect a surface temperature of the fixing belt at a detection position at which heating intensity of a corresponding one of the plurality of heat sources is not affected by any other one of the plurality of heat sources;

a nip formation member contacting the rotary pressing member via the flexible fixing belt; and a support member to support the nip formation member, wherein, at the detection position of each of the plurality of temperature detectors, the heat intensity of the corresponding one of the plurality of heat sources is not affected by the support member.

16. The fixing device according to claim 15, wherein the support member has a bottom face and two side faces, and a space between the two side faces.

17. The fixing device according to claim 15, wherein a surface of the support member has a mirror finish reflecting radiated heat from the plurality of heat sources.

18. An image forming apparatus comprising a fixing device according to claim 15.

19. A fixing device comprising:

a flexible fixing belt looped for rotation;

a rotary pressing member disposed opposing the flexible fixing belt interposed therebetween, forming a nip between the fixing belt and the rotary pressing member;

a plurality of heat sources disposed in the fixing belt; and a plurality of overheat prevention units provided corresponding to the plurality of heat sources and configured to detect a surface temperature of the fixing belt when the plurality of heat sources are in an OFF state irrespective of a rotational state and a stopped state of the fixing belt, the plurality of overheat prevention units being provided at a detection position at which heating intensity of a corresponding one of the plurality of heat sources is not affected by any other one of the plurality of heat sources.

20. The fixing device according to claim 19, further comprising:

a nip formation member held by a heat conductive member; and a support member to support the nip formation member, the support member having a bottom face and two side faces, and a space between the two side faces.

21. The fixing device according to claim 20, wherein a surface of the support member has a mirror finish reflecting radiated heat from the plurality of heat sources.

22. An image forming apparatus comprising a fixing device according to claim 19.

* * * * *